US005515031A

United States Patent [19]

Pereira et al.

[11] Patent Number: 5,515,031

[45] Date of Patent: May 7, 1996

[54] CREDIT CARD DETECTOR AND VALIDATOR

[76] Inventors: Neil H. Pereira, 4851 Rathkeale Road, Mississauga, Ontario, Canada, L5V 1K5; Andrew O. Nicholl, 4456 Badminton Drive, Mississauga, Ontario, Canada, L5M 3G8

[21] Appl. No.: 218,196

[22] Filed: Mar. 28, 1994

[51] Int. Cl.[6] ..... G08B 13/14

[52] U.S. Cl. ..... 340/568; 346/825.33; 346/825.34; 235/435

[58] Field of Search ..... 340/568, 825.32, 340/825.33, 825.34; 235/435

[56] References Cited

U.S. PATENT DOCUMENTS

| | | | |
|---|---|---|---|
| 3,637,990 | 1/1972 | Bayha et al. | 340/825.33 |
| 3,651,310 | 3/1972 | Link | 340/825.33 |
| 3,727,186 | 4/1973 | Stephenson, Jr. et al. | 340/825.33 |
| 3,891,830 | 6/1975 | Goldman | 340/825.33 |
| 3,946,204 | 3/1976 | Taniguchi et al. | 235/435 |
| 3,959,789 | 5/1976 | McGahee . | |
| 4,375,032 | 2/1983 | Uchida | 340/825.33 |
| 4,480,250 | 10/1984 | McNeely | 340/568 |
| 4,692,745 | 9/1987 | Simanowitz | 340/568 |
| 4,717,908 | 1/1988 | Phillips et al. . | |
| 4,890,094 | 12/1989 | Kopel . | |
| 4,916,434 | 4/1990 | McNeely . | |
| 5,091,713 | 2/1992 | Horne et al. | 340/825.33 |

*Primary Examiner*—John K. Peng
*Assistant Examiner*—Benjamin C. Lee
*Attorney, Agent, or Firm*—Barrigar & Moss

[57] ABSTRACT

Apparatus and a method are disclosed for detecting that a credit card has not been returned to a user after use or that an incorrect card has been returned. A card holder holds one or more credit cards or the like and includes means for reading and storing a unique identification code applied to the cards. When a particular card is removed from the holder and not returned within a predetermined time interval, an alarm is activated. If a card having an incorrect identification code is returned to the card holder, an alarm is also activated. Further, if a card having an incorrect identification code is removed from the card holder, an alarm is also activated. The apparatus is programmable and password protection is optionally provided.

23 Claims, 6 Drawing Sheets

CREDIT CARD DETECTOR AND VALIDATOR

BACKGROUND OF THE INVENTION

1. Field of the Invention

This invention relates to devices for protecting against the accidental loss and subsequent misuse of valuable cards, such as credit cards, bank cards, telephone calling cards, etc., and in particular, to devices that give a warning that a credit card has not been returned after use, or that an incorrect card has been returned, or that require a password to be used prior to an authorized use of a card.

2. Description of the Related Art

Many people today carry in their wallets or purses several cards, such as credit cards, telephone calling cards, driver's licenses, membership cards, etc. It is often convenient to hold all of these cards in one dedicated credit card wallet or carrier. Sometimes these carriers are thin enough that they can be in the form of an insert to be put into an ordinary wallet. When a person wishes to use a credit card, such as in a restaurant, it is normally removed from the carrier or wallet, handed to a server, and the carrier or wallet is put into a purse or pocket until the card is returned.

It often happens that the card is not returned to the user, or perhaps some other person's card is returned, and this is not noticed by the user, who then leaves the business establishment. It may be several days or longer before it is discovered that the card is missing. Sometimes the user cannot remember where the card was left. The user can notify the card issuer of the lost card, but by the time this happens, the card could get into the hands of someone who may use the card fraudulently and the owner of the card normally is responsible for all charges until the card issuer is notified of the loss of the card. Also, a missing card represents an administrative burden and possibly also a financial loss to the card issuer or financial institution issuing the card.

In order to overcome this problem, several card carriers have been invented with a built-in alarm. The alarm is activated by one or more switches that are actuated by the removal of a credit card from the card carrier. A master switch disables the alarm while the card carrier is out in the open, but if a person tries to put the card carrier back into a pocket or purse without the card being returned, the alarm is activated. An example of such a card carrier is shown in U.S. Pat. No. 4,692,745 issued to Solly Simanowitz. The difficulty with this device, however, is that a person cannot put the card carrier away in a pocket or purse while waiting for the card to be returned. Also, the device cannot determine if an incorrect card is returned to the carrier, nor can password protection be implemented in such devices.

Another type of credit card monitor is shown in U.S. Pat. No. 3,959,789 issued to Francis M. McGahee. The device in this patent also has an alarm, but the alarm is activated by a timer which is energized by the closure of a switch upon the removal of a credit card. This device also has the drawback that it cannot determine if an incorrect card has been returned to the carrier. It also cannot provide password protection in connection with the use of the cards.

SUMMARY OF THE INVENTION

The present invention is a card carrier that identifies a particular card and activates an alarm if that particular card is not returned to the card carrier or an incorrect card is returned to the card carrier.

According to one aspect of the invention, there is provided a credit card detector and validator comprising a card holder dimensioned approximately the size of a credit card and adapted to hold the credit card which has a unique identification code associated therewith. Card reader means is mounted in the card holder for reading the identification code. A read/write memory is connected to the card reader and control means operatively connected to the memory allows for the selective storing of the identification code. A comparator is connected to the card reader means and the memory, the comparator including means for generating a signal if the identification code stored in the memory is not read by the card reader means. Also, an alarm is operatively connected to the signal means to be activated in the presence of the signal.

According to another aspect of the invention, there is provided a credit card detector and validator comprising a card holder adapted to hold a credit card having a unique identification code. A switch is mounted in the card holder to be actuated upon removal of the credit card from the card holder. A timer is connected to the switch to be activated upon actuation of the switch. An alarm is connected to the timer to be activated a predetermined time interval after the timer is activated. Card reader means is mounted in the card holder for reading the identification code. A memory is mounted in the card holder for storing said identification code. Also, a comparator is connected to the card reader means, the memory and one of the alarm and the timer, the comparator including means for deactivating the alarm upon reinsertion into the card holder of a credit card having the identification code stored in memory.

According to yet another aspect of the invention, there is provided a method of preventing the loss of a credit card. The method comprises the steps of providing the credit card with an identification code and providing a card holder with means for reading and memorizing the identification code. The identification code is read and memorized. The removal of a credit card from the card holder is detected and the time interval during which the credit card is removed from the holder is measured. Also, an alarm is sounded if a credit card with the identification code is not returned to the card holder within the predetermined time interval.

BRIEF DESCRIPTION OF THE DRAWINGS

Preferred embodiments of the invention will now be described, by way of example, with reference to the accompanying drawings, in which.

DESCRIPTION OF THE PREFERRED EMBODIMENTS

Figure 1:
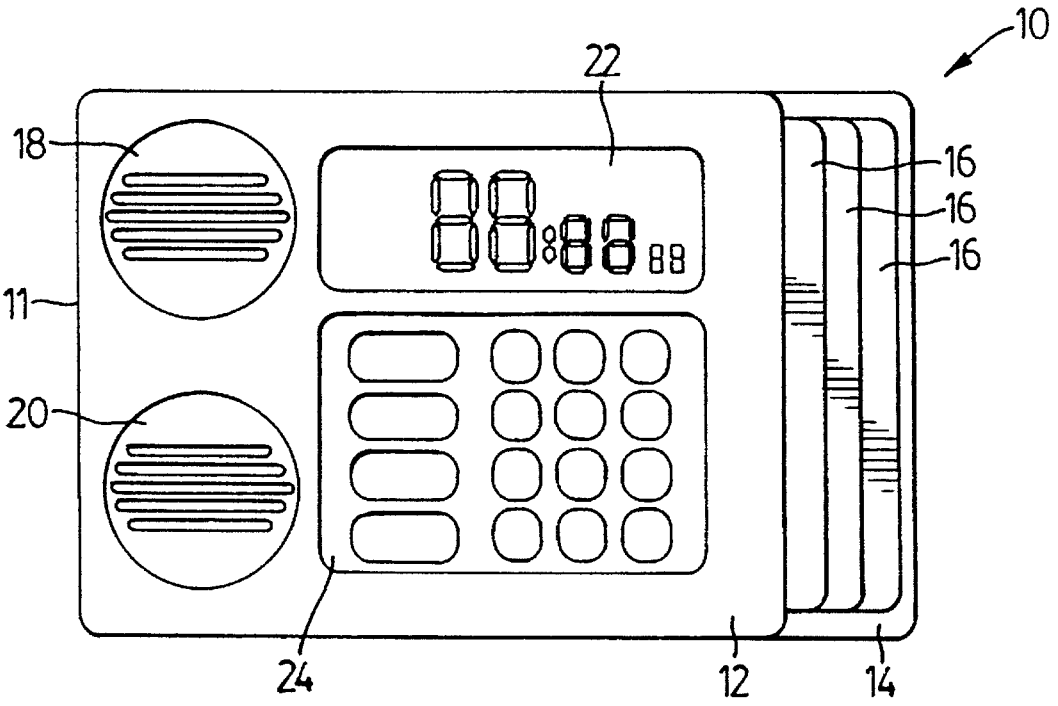
FIG. 1 is a top or plan view of a preferred embodiment of a credit card detector and validator according to the present invention.

Referring firstly to FIG. 1, a preferred embodiment of a credit card detector and validator, or a credit card carrier or holder according to the present invention is generally indicated by reference numeral 10. Card holder 10 has a housing 11 including a lid or top 12 and a bottom 14. Three credit cards 16 are shown located in card holder 10, but holder 10 can be made to hold one or two cards or more than three cards, as desired. Card carrier or holder 10 is primarily used for credit cards, but it will be appreciated that any other type of card can be used with card holder 10, such as membership cards, other bank cards, telephone calling cards, identification cards, etc. Virtually any document or card that is desired to be protected from loss can be used with card holder 10 by making suitable modifications to the physical shape or configuration of the card holder. For the purposes of this specification, the term credit card is intended to include all such types of cards or documents.

Card holder 10 includes an alarm 18, which in the preferred embodiment is an audio alarm such as a speaker or buzzer, but it could be a visual alarm such as some type of light, or a sensual alarm such as a vibrator, or a combination of the above. A power source 20, preferably in the form of a battery, is provided to power the electronic circuitry of card holder 10. Actually, in FIG. 1, reference numeral 20 indicates a removable cover behind which the battery or power source is located. A display 22 and a keypad 24 are mounted in top 12 for programming the circuitry of card holder 10, which in addition to the credit card detector and validator functions, may also include such things as a clock, a calculator, currency conversion or even a credit card transaction log.

Figure 2:
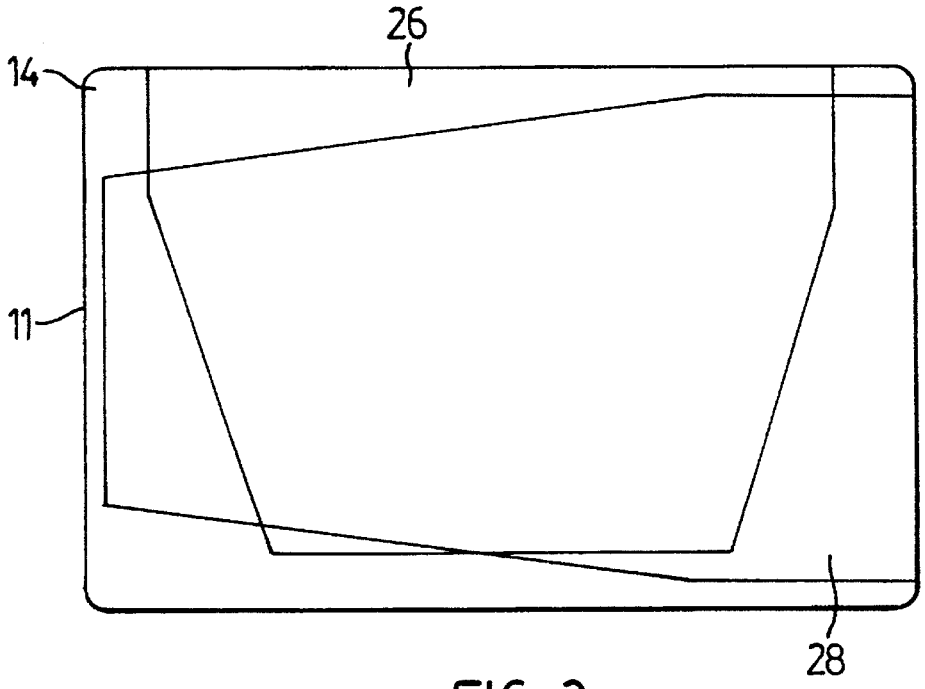
FIG. 2 is a bottom view showing the underside of the detector and validator shown in FIG. 1.

FIG. 2 shows the back or underside of card holder 10 and it shows optional transverse or longitudinal clips or flaps 26, 28 for mounting card carrier 10 in a wallet or purse. The top 12 and bottom 14 are preferably formed of rigid plastic, but flaps 26, 28 preferably are formed of flexible material, but they could be made of rigid or spring material if it is desired to have card holder 10 clip onto an article such as a belt or a pocket.

Figure 3:
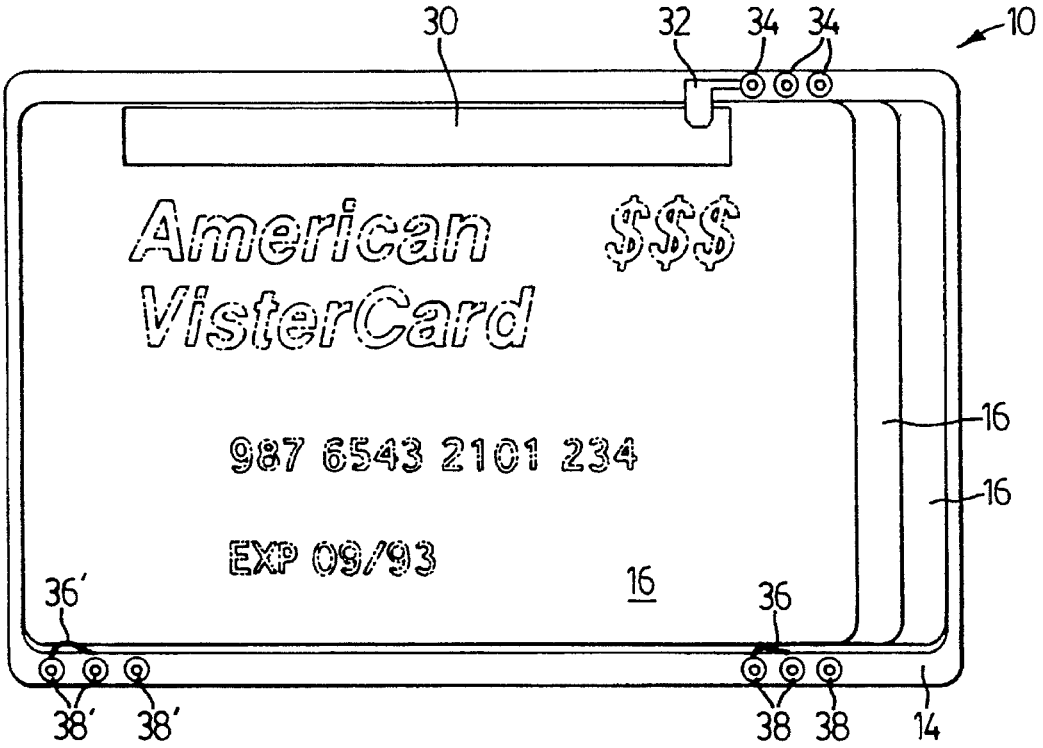
FIG. 3 is a plan view similar to FIG. 1 with the top of the detector and validator removed.
Figure 4:
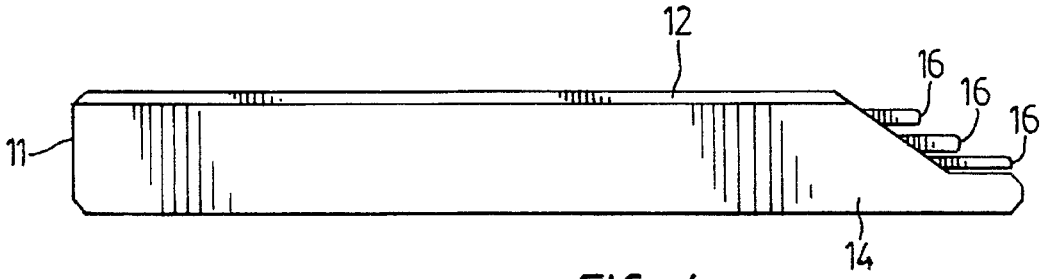
FIG. 4 is a front or elevational view of the detector and validator shown in FIG. 1.

FIG. 3 shows card holder 10 with top 12 removed. Each credit card 16 has an identification code 30 applied thereto or formed integrally therewith. In the preferred embodiment, identification code 30 is applied to credit cards 16 by means of an adhesive strip or stripe or tape having a variable magnetic pattern formed therein. Such tapes are supplied with card holder 10, so that they can be applied to any cards a user desires, and it is not necessary for a card issuer to produce special cards for this invention. The variable magnetic pattern is unique to the user of card holder 10. This is done by magnetically encoding the tapes with a pseudo-random variable code whose periodicity is such that the tapes supplied to any one user are extremely unlikely to be duplicated and used in the same business establishment at the same time. Different magnetic patterns are preferably used for each of the tapes for the credit cards to be contained in card holder 10 and used by a single user, but the same magnetic pattern can be used for each individual tape or card, if desired. Instead of a separate tape or stripe being applied to the credit card as identification code 30, it is possible to use the existing magnetic stripe that comes with the credit card depending upon the means used to read this stripe, as discussed further below. However, some cards that will be desired to be used in card holder 10 do not have an inherent magnetic stripe, so a separate tape or stripe provided with card holder 10 will be required for identification code 30. Another possibility is to use strips of variably conductive material in conjunction with miniature contact switches to "read" these strips.

A card reader means is used to read identification code 30 and in the preferred embodiment this includes a magnetically sensitive transistor, such as a Field Effect Transistor (FET) 32, or a Hall Effect Transistor (HET) or some other transistor that can be physically incorporated into card holder 10. For the purposes of this specification, the term FET is intended to include generically, all such types of transistors. One FET 32 is associated with each credit card 16 and FETs 32 are connected to respective pin receptacles 34 which receive pins (not shown) mounted in top 12 to electrically connect FETs 32 to the electronic circuitry in top 12.

A card presence switch 36 is associated with each card 16. Switches 36 are electrically connected to pin receptacles 38 which receive pins (not shown) mounted in top 12 to electrically connect switches 36 to the circuitry in top 12. Switches 36 can be simple spring contact switches which also serve to hold credit cards 16 firmly in card carrier or holder 10. Alternatively, pressure sensitive electronic devices, such as piezoelectric devices, may be used if desired. Credit cards 16 are actually located in individual slots in the bottom 14 of housing 11, but these have been omitted from the drawings for the purposes of illustration.

Optional card presence switches 36' and pin receptacles 38', which are similar to presence switches 36 and pin receptacles 38 can be provided adjacent to the inner ends of cards 16 to actuate the electronic circuitry, and in particular the card reader means, of card holder 10 upon removal of credit cards 16, as described further below.

Figure 5:
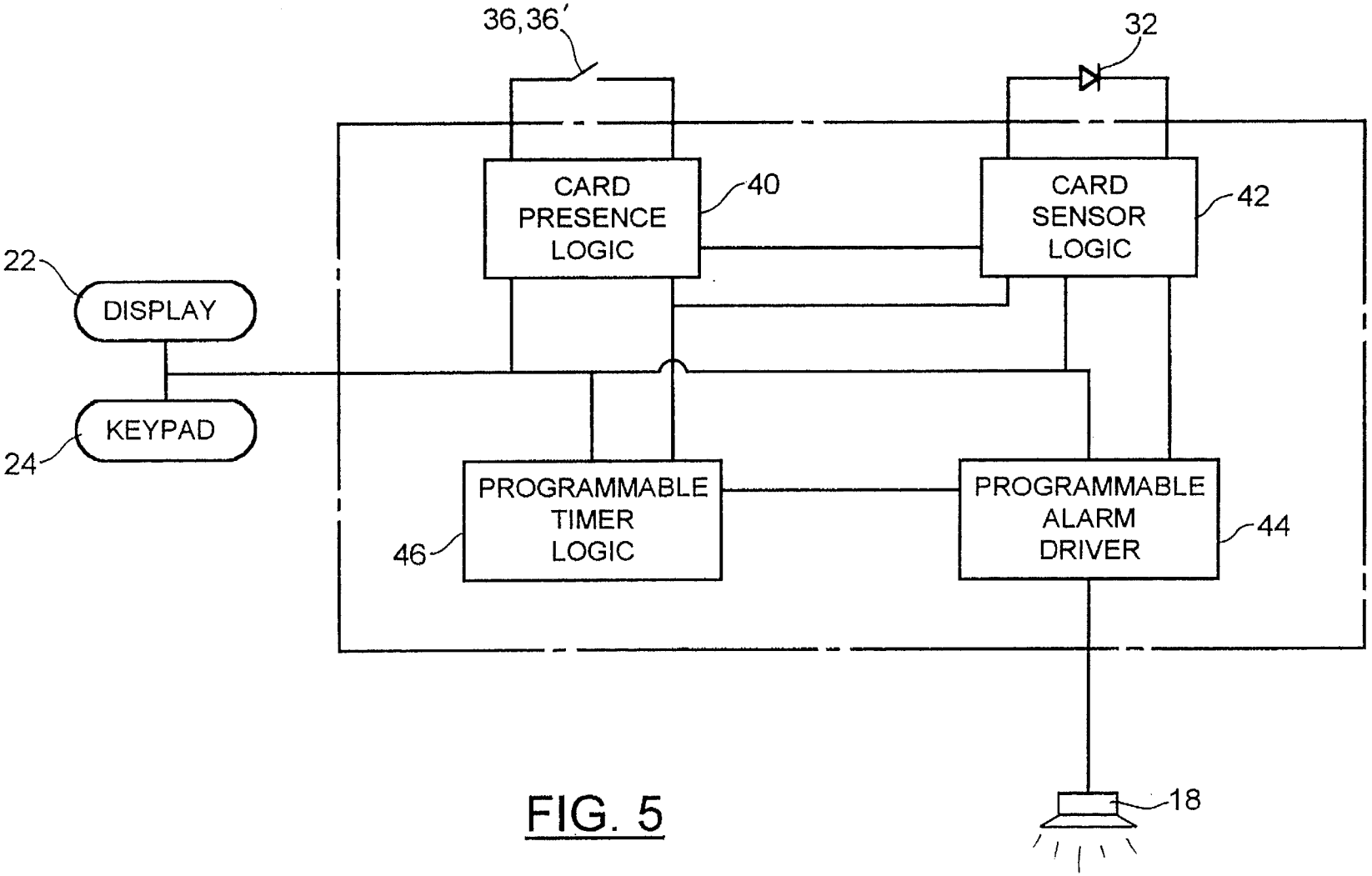
FIG. 5 is a schematic circuit diagram for the detector and validator of the present invention.
Figure 6:
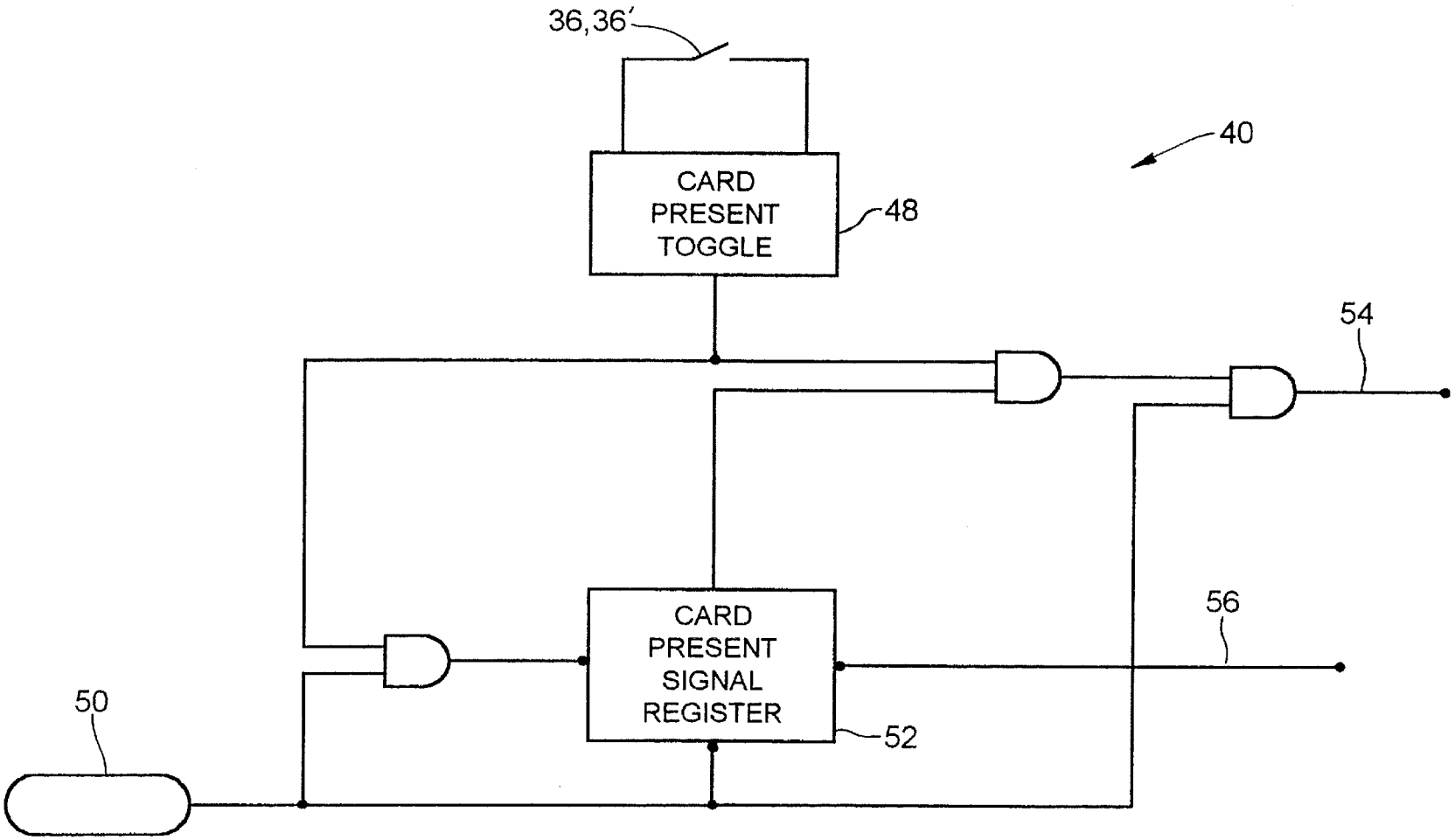
FIG. 6 is a logic circuit diagram illustrating the card presence logic of the circuit diagram of FIG. 5.

Referring next to FIG. 5, the general operation of the electronic circuitry of card holder 10 will now be described. When a credit card 16 is inserted into card holder 10, its associated card presence switch 36 is actuated activating card presence logic circuit 40 (FIG. 6). Card presence logic circuit 40 determines how many credit cards are in card holder 10 and if all of the cards are present or absent. Card holder 10 can be used with fewer cards than it is capable of holding, so it has to know how many cards should be present so it can determine if one of the cards is absent. To identify the credit card, a card sensor logic circuit or comparator 42 (FIG. 7) is provided. Card sensor logic circuit 42 uses FET or HET 32 to read identification code 30 on a card 16, either upon insertion or removal of card 16 from card holder 10, after card holder 10 has been initially programmed as described further below. The identification codes read by card reader FETs 32 are compared with that stored in memory, and if they do not match, a signal is generated which is sent to a programmable alarm driver 44 to activate alarm 18.

A programmable timer logic circuit 46 is connected to card presence logic circuit 40, card sensor logic circuit 42, and programmable alarm driver 44 as well as keypad 24 for programming timer logic circuit 46. Timer logic circuit 46 can be used in different ways. One way is to have it cause the card presence logic circuit 40 and card sensor logic circuit 42 check to see if all of the correct cards are in card holder 10 after a predetermined or programmable time interval, and if not, alarm driver 44 actuates alarm 18. Another way is to cause a time delay between the time the card presence switches 36, 36' are closed and the card reader or card sensor logic circuit 42 is activated. In this way, if a credit card is removed from card holder 10 and returned within a predetermined or programmable time interval, no signal would be sent to activate alarm 18.

Card holder 10 is initially programmed when it is first used with a card with a newly applied magnetic stripe or strip. The user inserts the card into card holder 10 which is set to the programming mode using keypad 24. This allows card holder 10 to read and store the unique identification code 30 for this particular card and latterly compare that code with the card code read in normal operation.

Referring next to FIG. 6, card presence logic circuit 40 includes a card present toggle 48 which, upon actuation of card presence switch 36 or 36' causes an output signal to be generated indicating that a credit card 16 is respectively being inserted into or removed from card holder 10. A program key 50 on keypad 24 provides an enabling signal or card present signal register 52 when card holder 10 is initially programmed, so that the output signal produced by card present toggle 48 upon insertion of a card is combined with the input signal from program key 50 to register in card present signal register 52 that card holder 10 is holding one of the cards. When a card is subsequently inserted into or removed from card holder 10 the consequent signal generated by card present toggle 48 is compared or matched with card present signal register 52, and a card present signal is generated at line 54. In this way, card presence logic circuit 40 determines if the intended card is located in card holder 10, or if it has been removed.

Figure 7:
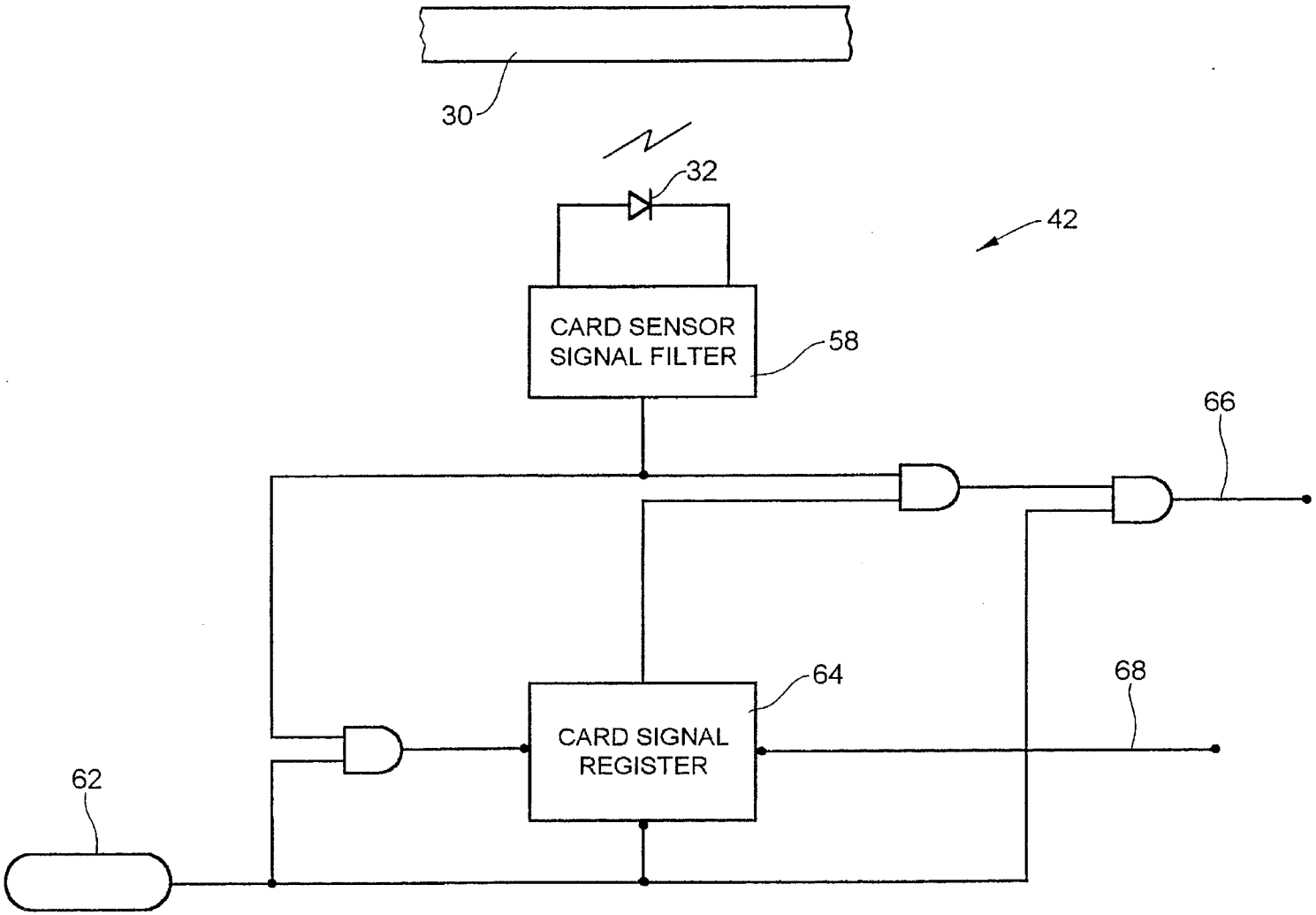
FIG. 7 is a logic circuit diagram illustrating the card sensor logic of the circuit diagram of FIG. 5.

Referring next to FIG. 7, card sensor logic circuit or comparator 42 includes a card sensor signal filter 58 which produces an output signal which is responsive to the card reader and is unique in respect of the identification code 30 read by FET or HET 32. Card sensor filter signal logic 58 is triggered to produce its output signal by changes in card present signal 54 (of card presence logic circuit 40). A program key 62 in keypad 24 which preferably would be the same as program key 50 but used in combination with another key, is used to enter or program card signal register 64. When card sensor logic circuit 42 is first programmed upon the insertion of a credit card 16, the input or enabling signal from program key 62 is combined with the output signal from card sensor signal filter 58 to store identification code 30 in card signal register 64. This is done for each card 16 to be carried in card holder 10. When the card reader subsequently reads identification code 30 upon the insertion or removal of a credit card 16 whose identification code is ostensibly stored in register 64, the output signal from card sensor signal filter 58 is compared to or matched with the identification code held in card signal register 64, and if a match is found, a card correct signal is generated at line 66.

Figure 8:
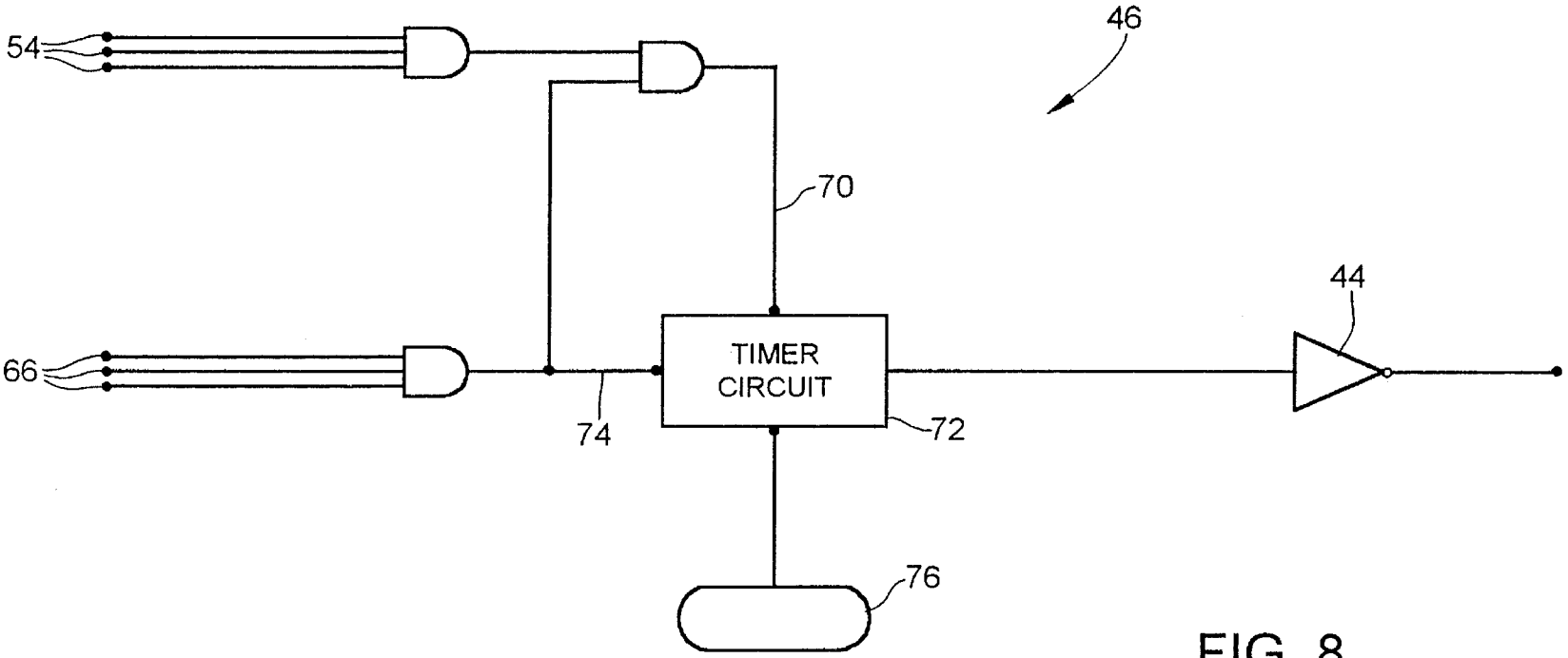
FIG. 8 is a logic circuit diagram illustrating the timer circuit logic of the circuit diagram of FIG. 5.

Referring next to FIG. 8, which shows one embodiment of timer logic circuit 46, if card present signal 54 is generated for each slot in card holder 10 and a card correct signal 66 is generated for each card associated with the slot, a disable signal 70 is generated for timer circuit 72 which prevents an output from going to alarm driver 44, so that alarm 18 is not activated. If one of the cards is removed or a card is returned to card holder 10 with an incorrect identification code so that one of the card correct signals 66 is not produced, a timer enable signal 74 is generated causing timer circuit 72 to activate alarm driver 44 after a predetermined time interval thus activating alarm 18. A program key 76, which again preferably would be the same as program key 50 but used in combination with another key, is used to program timer circuit 72 to vary the predetermined time interval as desired.

The electronic circuits of card holder 10 preferably are incorporated in one application specific integrated circuit mounted in top 12 of housing 11. However, one or more printed circuit boards could also be used, with some of the components being mounted in bottom 14, if desired. The exact circuit configuration to some extent is a matter of design choice based on cost and ergonomic factors, but within the design skills of a person skilled in the art. The choice of components, such as the type of card reader can also be varied. However, it is important that size be taken into consideration. For example, if a card reader is chosen to read conventional magnetic stripes on credit cards, or a bar code reader is used with a bar code for identification code 30, or a variable conductor strip is used in conjunction with miniature contact switches as mentioned above, then these readers would have to be made small enough so that card holder 10 would not be too bulky. It will also be appreciated that other conventional features can be built into card holder 10, such as a clock or a calculator, a credit card transaction register or a currency conversion circuit. Also, the signal processors can be programmed so that a password is required on the keyboard to program the card holder, or a password can be entered to disable the alarm circuitry, if desired.

It will be apparent to those skilled in the art that in light of the foregoing disclosure, many alterations and modifications are possible in the practice of this invention without departing from the spirit or scope thereof. Accordingly, the scope of the invention is to be construed in accordance with the substance defined in the following claims.

What is claimed is:

1. A personal credit card detector and validator comprising:

(a) a card holder, the card holder being dimensioned approximately the size of a credit card for the containment thereof and including a suitable battery receptacle;

(b) card reader means mounted in the card holder for reading a unique identification code from and associated with the credit card in response to insertion or removal of the credit card with respect to the card holder;

(c) a read/write memory operatively connected to the card reader;

(d) control means operatively connected to the memory for selectively storing the identification code read by the card reader means into the memory to initialize the card detector and validator;

(e) a comparator operatively connected to the card reader means and the memory, the comparator including means for generating a signal if the identification code stored in the memory is not read by the card reader means subsequent to said initialization; and (f) an alarm operatively connected to the signal generating means to be activated in the presence of said signal.

2. A credit card detector and validator as claimed in claim 1 and further comprising a switch adapted to be actuated upon removal of said credit card from the card holder, which switch is operably connected to the card reader means for the activation thereof when said credit card is being removed from the card holder.

3. A credit card detector and validator as claimed in claim 2 and further comprising a time delay means connected between the switch and the card reader means for operating the card reader means a predetermined time interval after removal of the credit card.

4. A credit card detector and validator as claimed in claim 3 wherein the card reader means is a FET, and wherein the card identification code is a variable magnetic pattern on the credit card readable by the FET.

5. A credit card detector and validator as claimed in claim 1 and further comprising a timer operatively connected to the comparator to activate the comparator a predetermined time interval after removal of the credit card from the card holder.

6. A credit card detector and validator as claimed in claim 5 and further comprising a switch adapted to be actuated upon removal of said credit card from the card holder, which switch is operably connected to the timer for the activation thereof when said credit card is being from the card holder.

7. A credit card detector and validator as claimed in claim 6 wherein the card reader means is a FET, and wherein the card identification code is a variable magnetic pattern on the credit card readable by the FET.

8. A credit card detector and validator as claimed in claim 6 wherein the card reader means is a bar code reader, and wherein the card identification code is a bar code.

9. A credit card detector and validator as claimed in claim 6 wherein the card reader means is a conventional credit card magnetic stripe reader and wherein the card identification code is a conventional credit card magnetic stripe.

10. A credit card detector and validator as claimed in claim 6 wherein the card holder is adapted to hold a plurality of credit cards, and further comprising a plurality of card reader means, one card reader means being associated with each credit card.

11. A credit card detector and validator as claimed in claim 1 and further comprising a switch adapted to be actuated upon insertion of said credit card into the card holder, which switch is operably connected to the card reader means for the activation thereof when said credit card is inserted into the card holder.

12. A credit card detector and validator as claimed in claim 11 wherein the card reader means is a FET, and wherein the card identification code is a variable magnetic pattern on the credit card readable by the FET.

13. A credit card detector and validator as claimed in claim 2 and further comprising a password controlled deactivator means connected to one of the comparator and the alarm for deactivating the alarm before removal of the credit card.

14. A credit card detector and validator as claimed in claim 5 wherein the timer includes means for adjusting the predetermined time interval.

15. A credit card detector and validator as claimed in claim 1 and further comprising a password controlled activator means operatively connected to one of the card reader means, the memory and the comparator, for requiring a password to be entered before said identification code can be stored in the memory.

16. A method of preventing the loss of a credit card, the method comprising the steps of:

providing the credit card with an identification code;

providing a card holder with means for reading and memorizing said identification code;

reading and memorizing said identification code;

detecting when said credit card is removed from or returned to the card holder;

measuring the time interval during which said credit card is removed from the holder; and sounding an alarm if a credit card with said identification code is not returned to the card holder within predetermined time interval.

17. A method of preventing the loss of a credit card as claimed in claim 16 wherein the identification code is a variable magnetic pattern and wherein said code is read using a FET as the means for reading said code.

18. A method of preventing the loss of a credit card as claimed in claim 17 wherein the magnetic pattern is one of a series of pseudo-random variable magnetic patterns with a periodicity such that duplication in the same area of use is unlikely.

19. A method of preventing the loss of a credit card as claimed in claim 16 and further comprising the steps of reading said identification code upon return of the credit card to the card holder; comparing the identification code read with the memorized identification code; and sounding an alarm if the identification code read differs from the memorized identification code.

20. A credit card detector and validator comprising:

a card holder adapted to hold a credit card having a unique identification code;

a switch mounted in the card holder to be actuated upon removal of said credit card from the card holder and deactivated upon reinsertion of said credit card into the card holder;

a timer connected to the switch to be activated upon actuation of said switch;

an alarm connected to the timer to be activated a predetermined time interval after the timer is activated;

a card reader means mounted in the card holder for reading said identification code;

a memory mounted in the card holder for storing said identification code; and a comparator connected to the card reader means, the memory and one of the alarm and the timer, the comparator including means for deactivating the alarm upon reinsertion into the card holder of a credit card having the identification code stored in the memory.

21. A credit card detector and validator as claimed in claim 20 wherein the card reader means is a field effect transistor, and wherein the card identification code is a variable magnetic pattern on the credit card readable by the field effect transistor.

22. A credit card detector and validator as claimed in claim 20 and further comprising means for varying the predetermined time interval.

23. A credit card detector and validator as claimed in claim 20 and further comprising a programmable circuit including a keypad and a display, the programmable circuit including subcircuits selected from the group consisting of a clock, a calculator, a currency converter or a transaction log.

* * * * *